US005317890A

United States Patent [19]

Wu

[11] Patent Number: 5,317,890

[45] Date of Patent: Jun. 7, 1994

[54] MORTISE LOCK LATCH ASSEMBLY

[76] Inventor: Danny K. T. Wu, No. 5, Lane 92, Sec. 5 Roosevelt Rd., Taipei, Taiwan

[21] Appl. No.: 41,667

[22] Filed: Apr. 1, 1993

[51] Int. Cl.[5] ..... E05B 23/00

[52] U.S. Cl. ..... 70/352; 70/418; 292/150

[58] Field of Search ..... 70/352, 418, 143, 478, 70/484, 485, 350, DIG. 6, DIG. 26; 292/150, 143, 346

[56] References Cited

U.S. PATENT DOCUMENTS

| | | | |
|---|---|---|---|
| 1,418,290 | 6/1922 | Deeds | 70/352 |
| 2,660,875 | 12/1953 | Jewett et al. | 70/352 |
| 3,011,817 | 12/1961 | Eads | 292/150 X |
| 3,026,703 | 3/1962 | Welch | 292/150 X |
| 4,848,118 | 7/1989 | Tesone | 292/346 X |

*Primary Examiner*—Lloyd A. Gall
*Attorney, Agent, or Firm*—Hedman, Gibson & Costigan

[57] ABSTRACT

A latch assembly for door locks. The latch assembly has (A) a box-shaped frame having two parallel plates each having a rectilinear slot, a curved slot with a middle section, (B) a first terminal section, (C) a second terminal section having a first shoulder and a second shoulder and (D) a hole for receiving a lock core. A dead bolt has (E) a first portion which is pressed by a finger extending from the core for retracting the dead bolt into the box-shaped frame, (F) a second portion which is pressed by the finger for moving the dead bolt out of the box-shaped frame, (G) a connection coupling the first portion with the second portion, (H) a recess extending in the connection, and (I) a passage transversely extending through the connection. A pin extends through the passage formed in the detent and its two ends are slidably received in the rectilinear slots. A detent has (J) a first portion slidably received in the recess, (K) a second portion and (L) a passage transversely extending through the second portion. A pin extends through the passage formed in the detent and its two ends are slidably received in the curved slots. A spring is compressed between the connection and the second portion of the detent. The ends of the pin are against the first shoulders when the finger is disengaged from the dead bolt and the spring will press the pin to further slide to be sited against the second shoulders.

1 Claim, 6 Drawing Sheets

MORTISE LOCK LATCH ASSEMBLY

BACKGROUND OF THE INVENTION

1. Field of Invention

The present invention relates to mortise locks and, more particularly, to a latch assembly for mortise locks.

2. Related Prior Art

Referring to FIG. 5, a mortise lock latch assembly in accordance with prior art has a box-shaped frame 40 which is generally securely attached to a lock stile of a door (not shown). The box-shaped frame 40 essentially consists of two parallel plates 42 each having a slot 44. A cylinder 46 has a circumferential slot 48. A ring 50 from which a finger 52 extends is sited in the slot 48. A core 54 is inserted through the cylinder 46 and the ring 50. The finger 52 is moved along the slot 48 when the ring 50 is rotated by the core 54 when activated by a key (not shown).

A dead bolt 56 has two separated parallel plates 58. Each plate 58 has (A) two cutouts in an edge so as to form shoulders 60 and 62 and a tab 64 sited between the shoulders 60 and 62, (B) a hole 66 defined near an opposite edge, (C) a slot 68 extending parallel to the edge wherein the cutouts are formed, (D) a hole 70 defined near a closed end of the slot 68, (E) a channel 72 extending through the hole 66. The channels 72 of the plates 58 constitute a passage for a spring 74.

A plate 76 has a first portion 78, a second portion 80 transversely extending from the first portion and a third portion 82 transversely extending from the second portion 80. The second portion 80 contains a longitudinal slot 84. Two teeth 86 transversely extend toward the first portion 78 from the third portion 82. Two separated strips 88 transversely extend from the third portion 82.

The plate 76 is sited between the plates 58 and a pin 90 is inserted through the holes 70 and the slot 84, thus the dead bolt 56 is attached to the plate 76. The spring 74 is inserted through the passage and retained between the strips 88. A pin 92 is inserted through the holes 66. The spring 74 is compressed between the third portion 82 and the pin 92. A pin 94 is inserted through the slots 68 and the space between the first and third portions 78 and 82. Two ends of the pin 94 are secured in two holes defined in the plates 58.

Referring to FIG. 6, the core 54 is activated in order to rotate the finger 52. The finger 52 is moved so that it presses the strip 76 and simultaneously compresses the spring 74. As being further rotated, the finger 52 abuts the shoulder 60 and moves the dead bolt 56 out of the box-shaped frame 40. The finger 52 is disengaged from the shoulder 60 when it is further rotated. That position is shown by a dashed line in FIG. 7. Obviously, after a revolution of the finger 52 is completed, a sufficient amount of the extension of the dead bolt 56 out of the box-shaped frame 40 for locking a door is not achieved as a clearance exists between the door and a jamb wherein a bolt-receiving hole is formed (not shown).

Referring to FIG. 8, the finger 52 continues to be rotated. The finger 52 presses the strip 76. The finger 52 abuts the tab 64. The finger moves the dead bolt 56 out of the box-shaped frame 40 by abutting the tab 64. Then, the finger 52 is disengaged from the tab 64.

A first problem of the above-mentioned mortise lock latch assembly is that the key must be rotated for at least two revolutions to lock the door. Generally, the key is rotated for 720° to move the dead bolt about 18 mm.

A second problem of the above-mentioned mortise lock latch assembly is that there is a position where the finger 52 is disengaged from the tab 64 and the strip 76 is not biased by means of the spring 74 to have the pin 94 sited between the teeth 86. If the bolt-receiving hole is blocked on purpose, the strip 76 will be stopped in such a position. The dead bolt 56 can be easily moved into the box-shaped frame by inserting a strong strip between the box-shaped frame and the jamb.

Therefore, the present invention is intended to solve the above-mentioned problems.

SUMMARY OF THE INVENTION

The present invention provides a latch assembly for door locks. The latch assembly has (A) a box-shaped frame having two parallel plates each having a rectilinear slot, a curved slot with a middle section, (B) a first terminal section, (C) a second terminal section having a first shoulder and a second shoulder and (D) a hole for receiving a lock core. A dead bolt has (E) a first portion which is pressed by a finger extending from the core for retracting the dead bolt into the box-shaped frame, (F) a second portion which is pressed by the finger for moving the dead bolt out of the box-shaped frame, (G) a connection coupling the first portion with the second portion, (H) a recess extending in the connection, and (I) a passage transversely extending through the connection. A pin extends through the passage formed in the detent and its two ends are slidably received in the rectilinear slots. A detent has (J) a first portion slidably received in the recess, (K) a second portion and (L) a passage transversely extending through the second portion. A pin extends through the passage formed in the detent and its two ends are slidably received in the curved slots. A spring is compressed between the connection and the second portion of the detent. The ends of the pin are against the first shoulders when the finger is disengaged from the dead bolt and the spring will press the pin to further slide to be sited against the second shoulders.

For a better understanding of the present invention and objects thereof, a study of the detailed description of the embodiments described hereinafter should be made in relation to the accompanying drawings.

DETAILED DESCRIPTION OF THE PREFERRED EMBODIMENT

Figure 1:
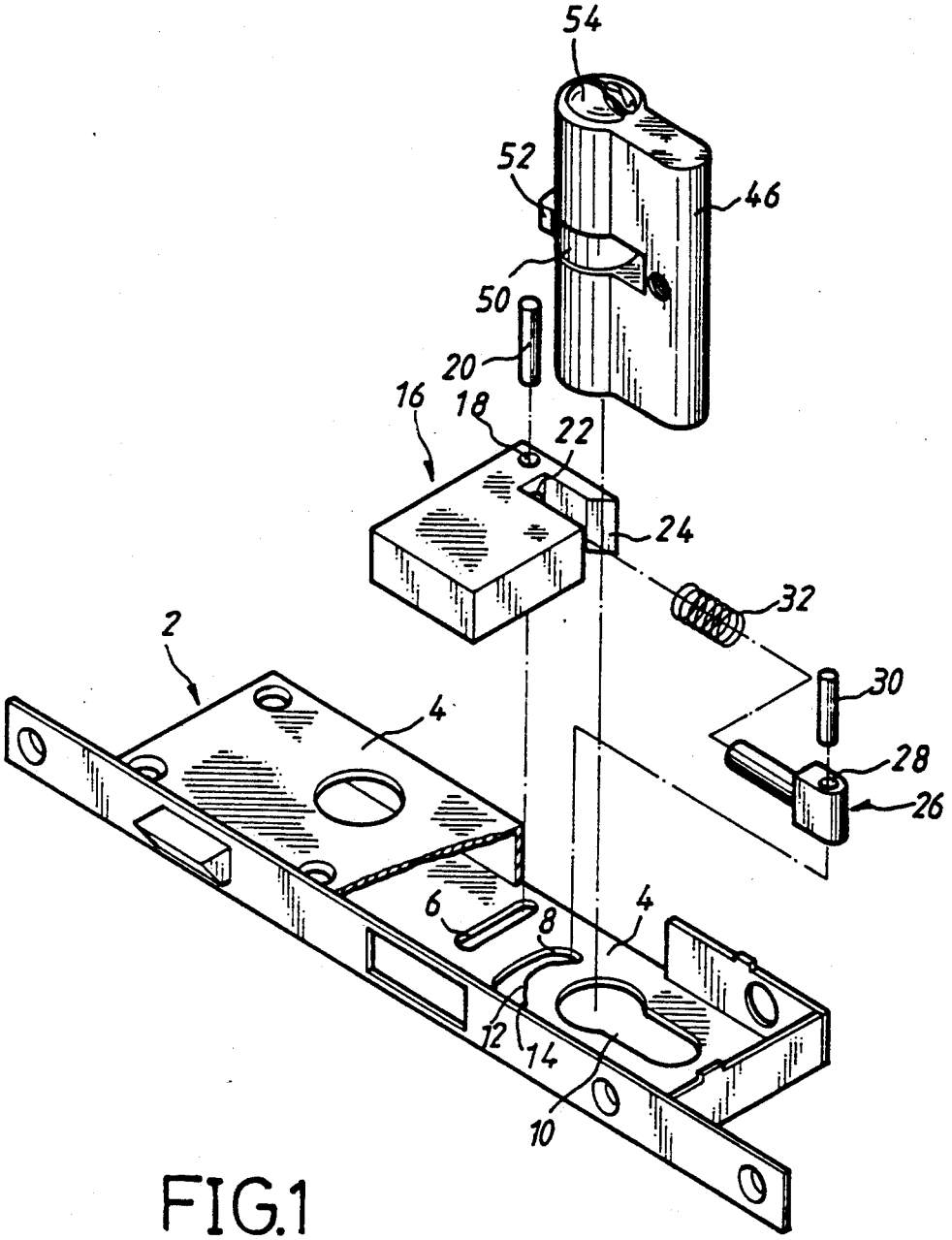
FIG. 1 is an exploded view of a latch assembly in accordance with the present invention.

Referring to FIG. 1, in accordance with the present invention, a latch assembly has a box-shaped frame 2 substantially consisting of two parallel identical plates 4 each having a rectilinear slot 6, a curved slot 8 and a hole 10 for receiving the cylinder 46. The cylinder 46, the slot 48, the ring 50, the finger 52 and the core 54 are identical to those indicated by the same reference numerals as mentioned in Related Prior Art, therefore, detailed description thereof will not be given hereinafter.

Figure 2:
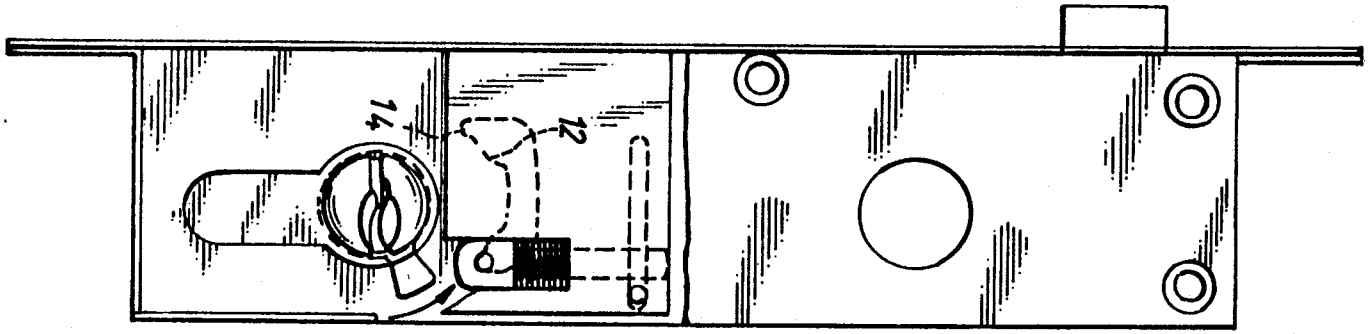
FIG. 2 is a front view of a latch assembly in accordance with the present invention.

Referring to FIG. 2, the rectilinear slot 6 extends perpendicular to a length of the plate 4. The curved slot 8 has a middle section extending generally parallel to the rectilinear slot 6 and first and second terminal sections extending away from the rectilinear slot 6. At the second terminal section of the curved slot 8, a lower edge is abruptly inclined so as to form a first shoulder 12, then smoothly inclined and again abruptly inclined so as to form a second shoulder 14.

Referring back to FIG. 1, a dead bolt 16 has a passage 18 for receiving a pin 20. Two ends of the pin 20 extend beyond the dead bolt 16 into the rectilinear slots 6. By means of a rectilinear clearance, the dead bolt 16 is divided into a first portion which is always retained in the box-shaped frame 2 and a second portion which is extendible out of the box-shaped frame 2. A recess 22 extends in the dead bolt 16 between the first and second portions, parallel to the rectilinear clearance. The first portion of the dead bolt 16 has an inclined shoulder 24 at its free end.

A detent 26 has a first portion which is slidably received in the recess 22 and a second portion having a transverse passage 28 for receiving a pin 30. Two ends of the pin 30 extend beyond the second portion of the detent 26 and are slidably received in the curved slots 8.

The dead bolt 16 and the detent 26 are slidably mounted on the box-shaped frame 2 as the ends of the pin 20 are slidably received in the rectilinear slots 6 and the ends of the pin 30 are slidably received in the curved slots 8. A spring 32 collars the first portion of the detent 26. The spring 32 presses the ends of the pin 30 against the lower edge of the curved slot 8 (see FIG. 2).

The ends of the pin 30 are sited in the first terminal sections of the curved slots 8 when the dead bolt 16 is retained in the box-shaped frame 2.

Figure 3:
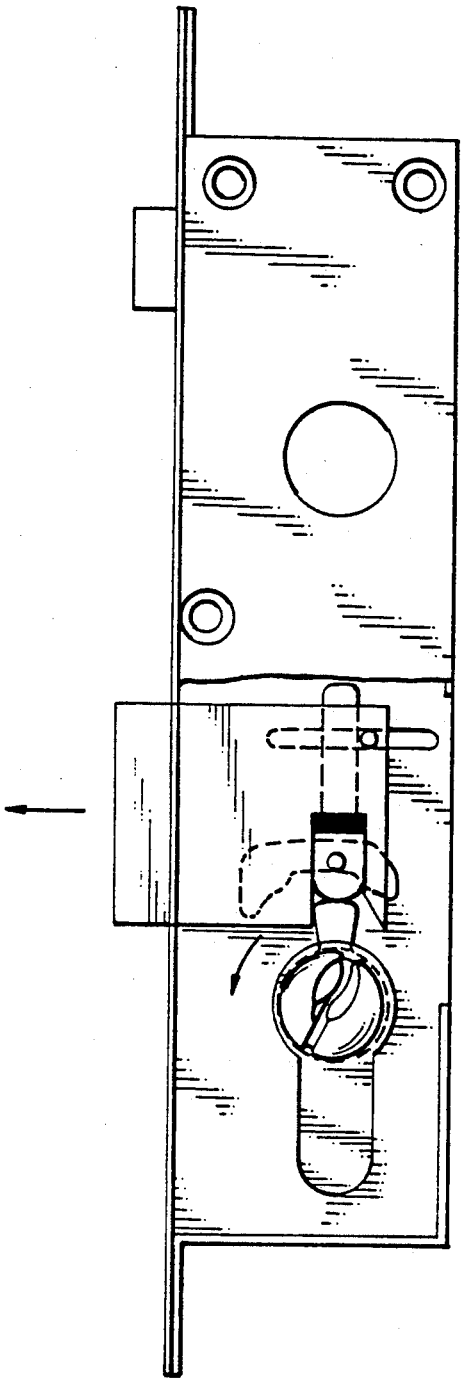
FIGS. 3 and 4 are views similar to FIG. 2, showing two subsequential steps of the extension of a dead bolt out of a box-shaped frame.

Referring to FIG. 3, the finger 52 is rotated so as to bypass the first portion of the dead bolt 16. As the finger 52 is further rotated in the same direction, it presses the detent 26 upward along the first terminal sections of the curved slots 8. After the ends of the pin 30 are disengaged from the first terminal portions of the curved slots 8, the pin 30 slides along the middle portions of the curved slots 8 with the finger 52 abutting the second portion of the dead bolt 16.

Figure 4:
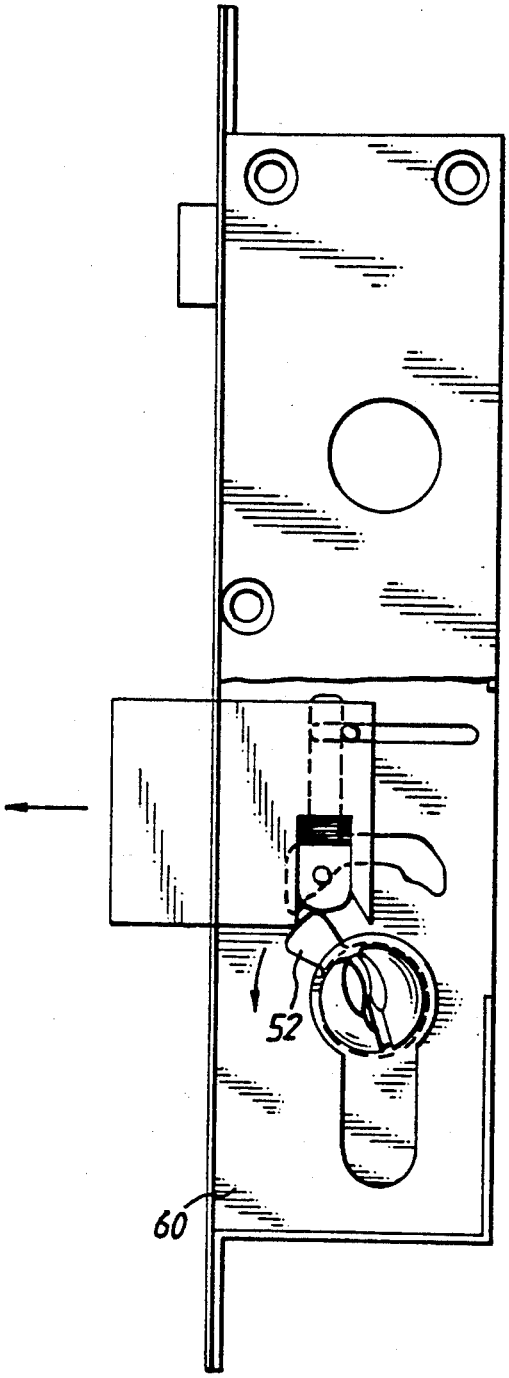
Figure 5:
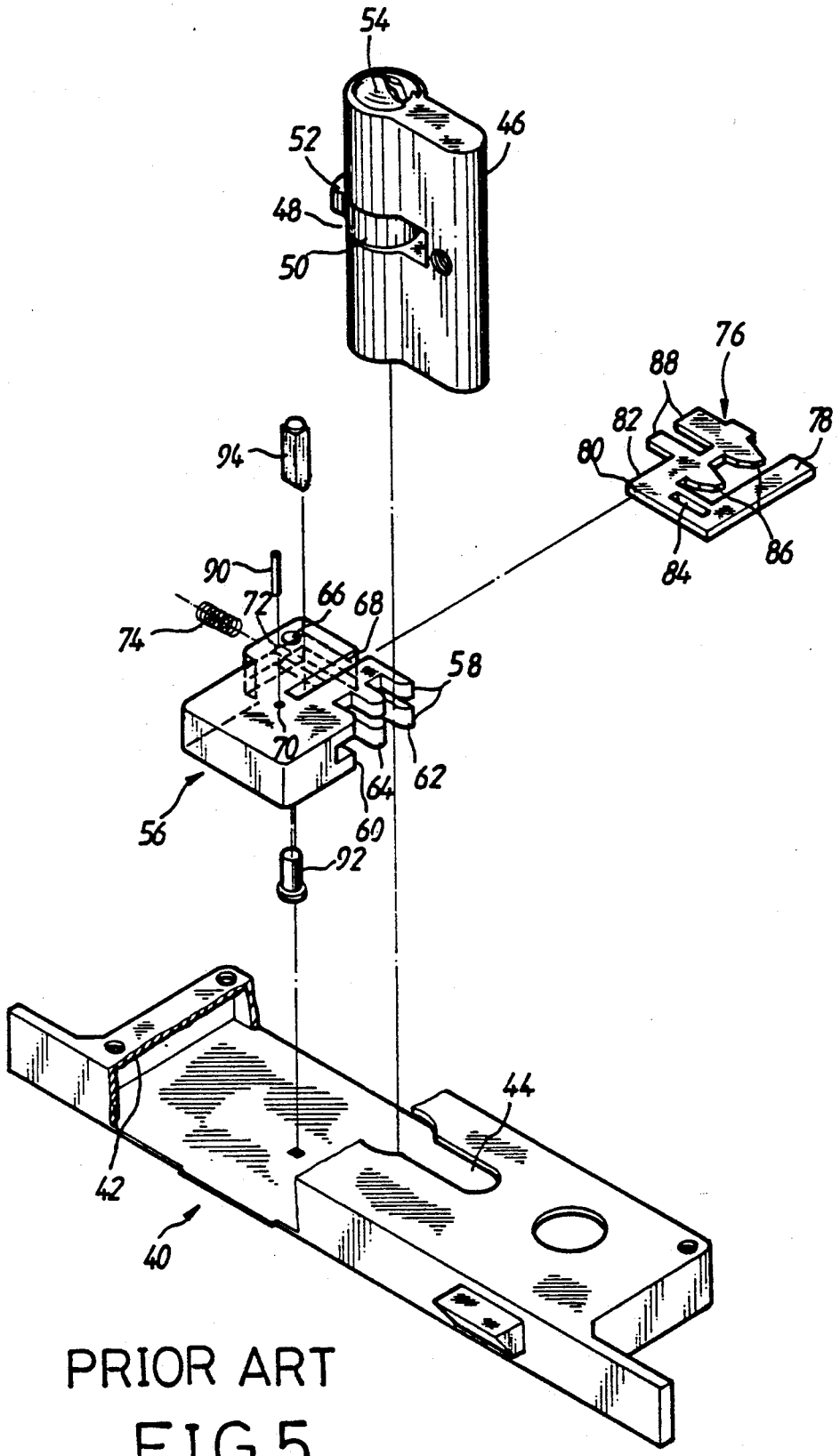
PRIOR ART FIG.5
FIG. 5 is an exploded view of a latch assembly in accordance with prior art.
Figure 6:
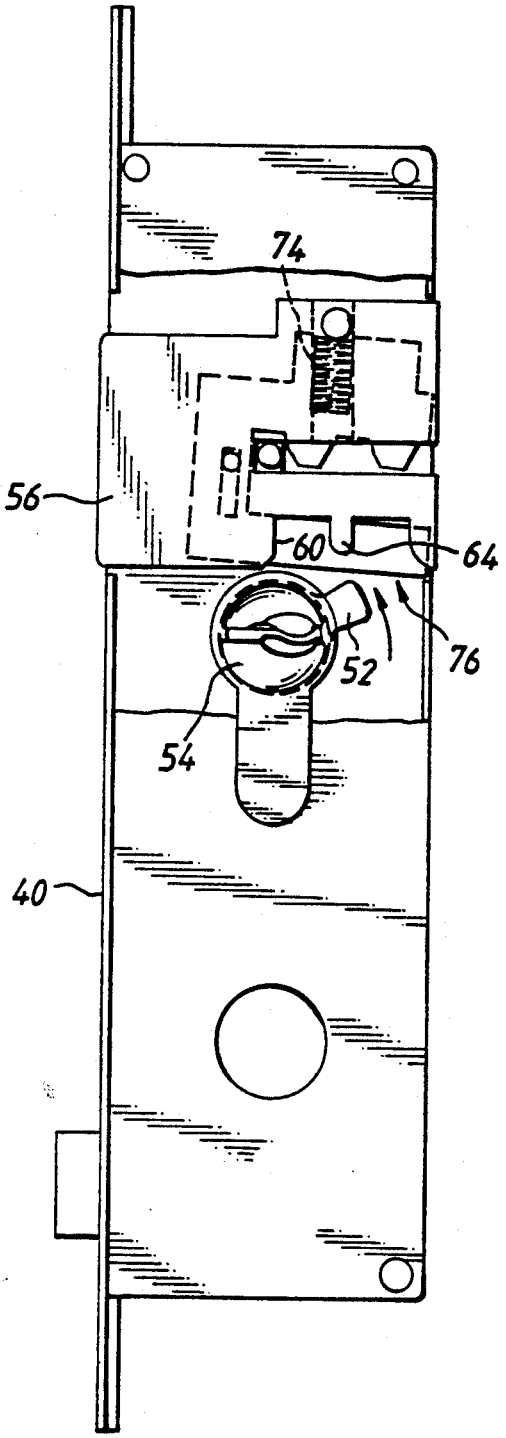
FIG. 6 PRIOR ART
FIG. 6 is a front view of a latch assembly in accordance with prior art.
Figure 8:
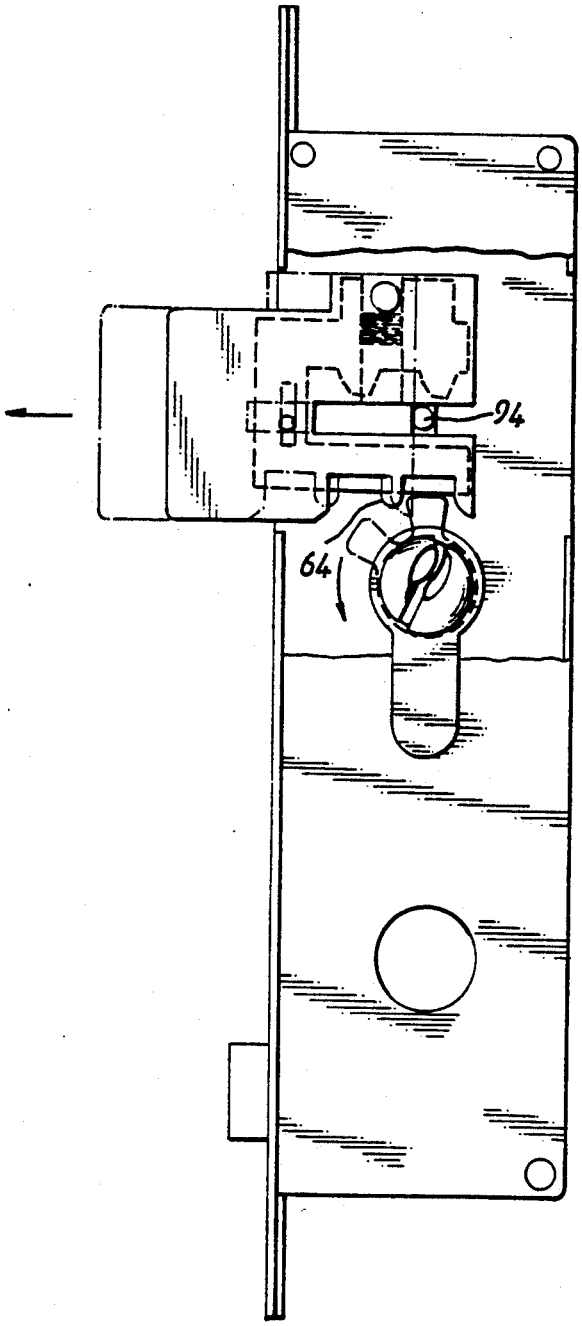
FIG. 8 PRIOR ART
FIGS. 7 and 8 are views similar to FIG. 6, showing two subsequential steps of the extension of a dead bolt out of a box-shaped frame.
Figure 7:
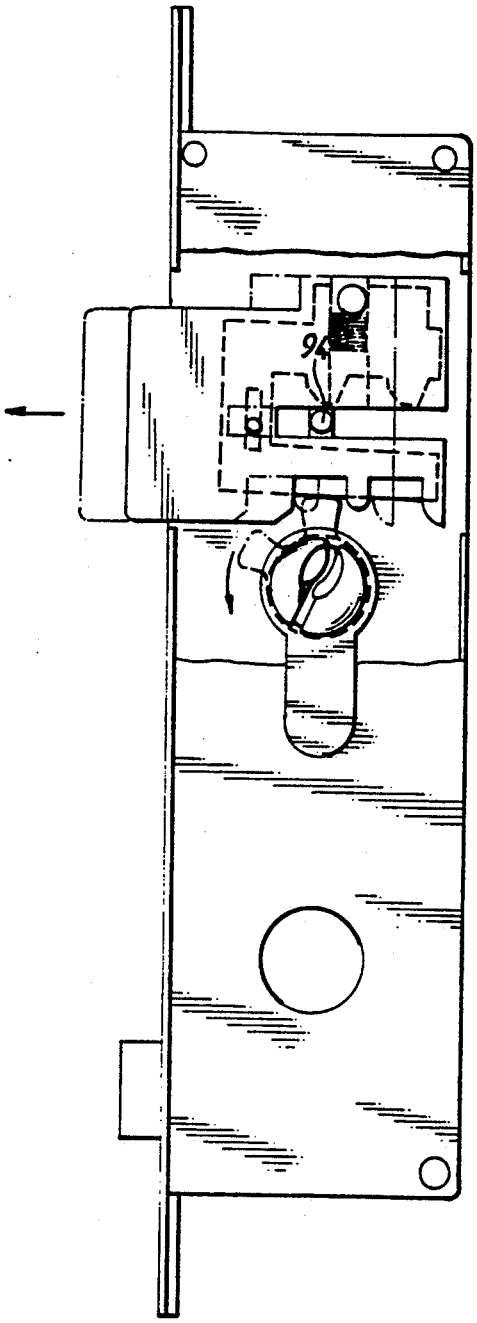
FIG. 7 PRIOR ART

Referring to FIG. 4, the ends of the pin 30 are sited in the second terminal sections of the curved slots 8 as the finger 52 is further rotated in the same direction. The ends of the pin 30 are against the shoulders 12 when the finger 52 is disengaged from the second portion of the dead bolt 16. Although the finger 52 no longer abuts the second portion of the dead bolt 16, the dead bolt 16 will not be pressed back into the box-shaped frame 2 as the shoulders 12 restrain the ends of the pin 30 from leaving the second terminal sections of the curved slots 8. Generally, the spring 32 will press the ends of the pin 30 further into the second terminal sections of the curved slots 8 so as to abut the shoulders 14.

In accordance with the present invention, a distance from the axis of rotation of the finger 52 to a lower edge of the dead bolt 16 is reduced. Thus, a movement of the dead bolt 16 is increased when the finger 52 is rotated.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

I claim:

1. A latch assembly for cooperating with a lock core, comprising:

a box-shaped frame having two parallel plates each having:

a rectilinear slot;

a curved slot consisting of a middle section extending generally parallel to said rectilinear slot, a first terminal section extending away from said rectilinear slot and a second terminal section extending away from said rectilinear slot, said second terminal section having a first shoulder and a second shoulder; and a hole for receiving the lock core;

a dead bolt having:

a first portion having a free end formed into an inclined shoulder which is pressed by a finger extending from the core for retracting said dead bolt into said box-shaped frame;

a second portion which is pressed by the finger for moving said dead bolt out of said box-shaped frame;

a connection coupling said first portion with said second portion of said dead bolt;

a recess extending in said connection parallel to said first portion of said dead bolt; and a passage transversely extending through said connection;

a first pin extending through said passage formed in said connection and having two ends slidably received in said rectilinear slots; and a detent having:

a first portion slidably received in said recess;

a second portion; and a passage transversely extending through said second portion of said detent;

a second pin extending through said passage formed in said detent and having two ends slidably received in said curved slots; and a spring compressed between said connection of said dead bolt and said second portion of said detent;

said ends of said second pin abutting said first shoulders when the finger is disengaged from said dead bolt as said dead bolt is extended from said frame, said spring pressing said detent for moving said ends of said second pin from said first shoulders to said second shoulders.

* * * * *